US006093051A

United States Patent [19]

O'Brien

[11] Patent Number: 6,093,051

[45] Date of Patent: Jul. 25, 2000

[54] LIGHT FIXTURE CONDUCTORS AND METHODS OF ASSEMBLY

[75] Inventor: Steven T. O'Brien, Brooklyn Park, Minn.

[73] Assignee: The Toro Company, Bloomington, Minn.

[21] Appl. No.: 08/872,493

[22] Filed: Jun. 6, 1997

[51] Int. Cl.[7] ..... H01R 4/24

[52] U.S. Cl. ..... 439/419; 439/856

[58] Field of Search ..... 439/419, 414, 439/619, 699.2, 733.1, 744, 746, 751, 668, 843, 856

[56] References Cited

U.S. PATENT DOCUMENTS

| | | | |
|---|---|---|---|
| D. 197,438 | 2/1964 | Harling et al. | D48/31 |
| D. 199,267 | 9/1964 | Harling et al. | D48/31 |
| D. 263,340 | 3/1982 | Budnovitch et al. | D26/67 |
| D. 284,312 | 6/1986 | Patel | D26/67 |
| D. 310,577 | 9/1990 | Kakuk et al. | D26/67 |
| D. 314,833 | 2/1991 | Beachy et al. | D26/68 |
| D. 330,778 | 11/1992 | Hall et al. | D26/68 |
| D. 366,713 | 1/1996 | Cornell et al. | D26/68 |
| 791,603 | 6/1905 | Beau et al. . | |
| 2,465,700 | 3/1949 | Tuttle | 240/10 |
| 2,570,751 | 10/1951 | Benander | 173/340 |
| 2,802,083 | 8/1957 | Lapeyre | 200/168 |
| 2,869,101 | 1/1959 | Benander | 339/99 |
| 3,056,943 | 10/1962 | Hull | 339/99 |
| 3,139,315 | 6/1964 | Baldo | 339/99 |
| 3,222,509 | 12/1965 | Thedford | 240/2 |
| 3,328,747 | 6/1967 | Dover et al. | 339/97 |
| 4,631,650 | 12/1986 | Ahroni | 362/249 |
| 4,653,829 | 3/1987 | LaMont | 339/97 L |
| 4,768,139 | 8/1988 | Poppenheimer | 362/302 |
| 4,774,648 | 9/1988 | Kakuk et al. | 362/302 |
| 4,793,823 | 12/1988 | Cozzens et al. | 439/409 |
| 4,826,448 | 5/1989 | Maddock | 439/409 |
| 4,870,548 | 9/1989 | Beachy et al. | 362/145 |
| 4,995,829 | 2/1991 | Geib et al. | 439/409 |
| 4,996,636 | 2/1991 | Lovett | 362/431 |
| 5,001,611 | 3/1991 | Beachy et al. | 362/145 |
| 5,007,855 | 4/1991 | O'Brien et al. | 439/411 |
| 5,055,987 | 10/1991 | Ellson et al. | 362/277 |
| 5,141,449 | 8/1992 | Tieszen | 439/419 |
| 5,280,417 | 1/1994 | Hall et al. | 362/226 |
| 5,297,013 | 3/1994 | Hall et al. | 362/363 |
| 5,321,592 | 6/1994 | Marinacci | 362/226 |
| 5,398,180 | 3/1995 | Lee | 362/431 |
| 5,429,530 | 7/1995 | Zander et al. | 439/622 |
| 5,709,566 | 1/1998 | Tsuji et al. | 439/699.2 |

*Primary Examiner*—Paula Bradley
*Assistant Examiner*—Tho Dac Ta
*Attorney, Agent, or Firm*—Mueting, Raasch & Gebhardt, P.A.

[57] ABSTRACT

A conductive element for a low voltage outdoor light fixture including a body having first and second ends; a wire piercing element proximate the first end of the body, the wire piercing element extending out of the wire support surface; a light bulb mount proximate the second end of the body; at least one ear protruding from the body, wherein each of the ears forms an aperture with the body, the aperture opening towards the second end of the body. Also disclosed is a method of assembling a low voltage outdoor light fixture including providing a head unit defining an interior volume and a first wire support surface, the head unit including two openings extending between the interior volume of the cone and the first wire support surface, each of the openings including a shoulder formed within the opening; providing two conductive members, each of the conductive members including a body having first and second ends, a wire piercing element proximate the first end of the body, a light bulb mount proximate the second end of the body; and at least one ear forming an aperture opening towards the second end of the body; and inserting one of the conductive members into each of the openings in the head unit by moving the wire piercing element through the opening to a position in which the wire piercing element extends out of the first wire support surface, wherein the ear on the body of the conductive member interlocks with the shoulder in the opening, whereby movement of the wire piercing elements of the conductive members towards the interior volume of the head unit is prevented.

11 Claims, 10 Drawing Sheets

LIGHT FIXTURE CONDUCTORS AND METHODS OF ASSEMBLY

FIELD OF THE INVENTION

The present invention relates to the field of low voltage outdoor light fixtures. More particularly, the present invention provides conductive members for making electrical contact between a bulb and a wire in low voltage outdoor light fixtures.

BACKGROUND OF THE INVENTION

Low voltage outdoor light fixtures for use in lighting paths, landscaping, architectural features etc. are known. The light fixtures are typically operated from power supplies that provide, e.g., 12 volts AC. Systems using the light fixtures are typically installed outdoors and include a transformer or power pack for providing the desired voltage level; a control system that may employ a timer, photocell, and/or manual on/off switch; one or more light fixtures typically mounted on a support member that supports the head unit of the light fixture above the ground; and at least one wire or cable for transmitting power from the transformer to the light fixtures. The wire used to supply power to the low voltage outdoor light fixtures typically includes two-conductors.

Electrical connection of the low voltage outdoor light fixtures to the wire can be accomplished by piercing the insulation or jacket of the wire to make contact with the enclosed conductor as described in, e.g., U.S. Pat. Nos. 4,774,648 (Kakuk et al.); 4,826,448 (Maddock); 4,996,636 (Lovett); 5,055,987 (Ellson et al.); and 5,280,417 (Hall et al.). Those systems also disclose the use of low voltage outdoor light fixtures including a head unit and a support member for supporting the light above the ground.

SUMMARY OF THE INVENTION

The present invention provides conductive members for making electrical contact between a bulb and wire in low voltage outdoor light fixtures and methods of assembling the conductive members in such light fixtures that provide a number of advantages. Among those advantages are that the preferred conductive members include both a wire piercing element as well as a bulb mount. The preferred conductive members can also be manually assembled into the head units of the light fixtures without discomfort.

In one aspect, the present invention provides a conductive element for a low voltage outdoor light fixture including a body having first and second ends; a wire piercing element proximate the first end of the body, the wire piercing element extending out of the wire support surface; a light bulb mount proximate the second end of the body; at least one ear protruding from the body, wherein each of the ears forms an aperture with the body, the aperture opening towards the second end of the body.

In another aspect, the present invention provides a low voltage outdoor light fixture including a head unit defining an interior volume and a wire support surface; two openings extending between the interior volume and the wire support surface, a shoulder being formed within each of the openings; two conductive members, each of the conductive members located in one of the openings, each of the conductive members including a body having first and second ends; a wire piercing element proximate the first end of the body, the wire piercing element extending out of the wire support surface; a light bulb mount proximate the second end of the body; at least one ear protruding from the body, wherein each of the ears forms an aperture with the body, the aperture opening towards the second end of the body, wherein the ear interlocks with the shoulder in the opening such that movement of the wire piercing element of the conductive member towards the interior volume of the head unit is prevented.

In another aspect, the present invention provides a method of assembling a low voltage outdoor light fixture including providing a head unit defining an interior volume and a first wire support surface, the head unit including two openings extending between the interior volume of the cone and the first wire support surface, each of the openings including a shoulder formed within the opening; providing two conductive members, each of the conductive members including a body having first and second ends, a wire piercing element proximate the first end of the body, a light bulb mount proximate the second end of the body; and at least one ear forming an aperture opening towards the second end of the body; and inserting one of the conductive members into each of the openings in the head unit by moving the wire piercing element through the opening to a position in which the wire piercing element extends out of the first wire support surface, wherein the ear on the body of the conductive member interlocks with the shoulder in the opening, whereby movement of the wire piercing elements of the conductive members towards the interior volume of the head unit is prevented.

These and other features and advantages of the present invention are discussed below in connection with representative embodiments and methods according to the present invention.

DETAILED DESCRIPTION OF THE PREFERRED EMBODIMENTS

Figure 1:
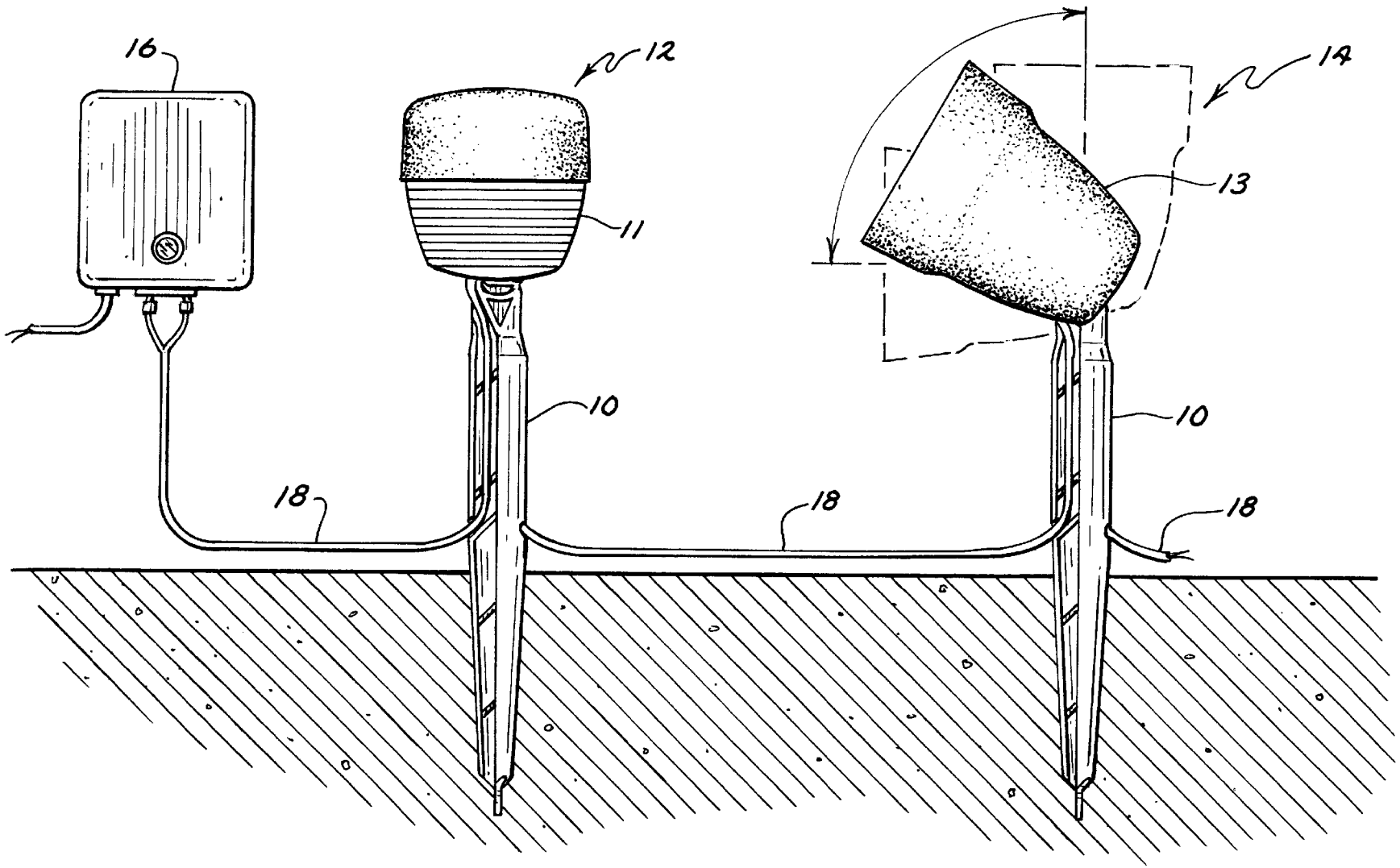
FIG. 1 is a schematic diagram of one system incorporating low voltage outdoor light fixtures according to the present invention.

Referring to the Drawings, wherein like numerals designate like parts and assemblies throughout the several views, FIG. I illustrates a system incorporating two low voltage outdoor light fixtures 12 and 14 manufactured according to the present invention. The system also includes a power source 16 and a wire 18 connecting the low voltage outdoor light fixtures 12 and 14 to the power source 16. The system includes low voltage outdoor light fixtures 12 and 14 that are preferably connected in parallel along a single two-conductor wire 18, although other system connection arrangements are contemplated.

Low voltage outdoor light fixture 12 includes a head unit 11 that is one embodiment of low voltage outdoor accent light fixture manufactured according to the present invention. Low voltage outdoor light fixture 14 includes a head unit 13 that is one embodiment of a floodlight or spotlight manufactured according to the present invention. Both head units 11 and 13 are supported by support members 10. Depicted support members 10 are typically stakes adapted to be inserted into the ground, although other support members such as posts, deck mounts, wall mounts, etc. can also be used to support the low voltage outdoor light fixtures. Preferably, the wire 18 is threaded through or along the support member 10 to reach the head units 11 and 13 of the low voltage outdoor light fixtures 12 and 14. By so doing, the aesthetic appearance of the low voltage outdoor light fixtures can be improved and the wire can be at least partially hidden during use.

The floodlight or spotlight fixture 14 preferably allows for rotation along a plane as shown in FIG. 1 to allow the direction of the light emitted from the fixture to be adjusted as needed to obtain the desired effect. Accent lights such as fixture 12 typically include a head unit 11 that is held in a fixed relationship with respect to the support member 10. Such lights are generally used for area lighting of pathways, sidewalks, landscaping etc.

Figure 2:
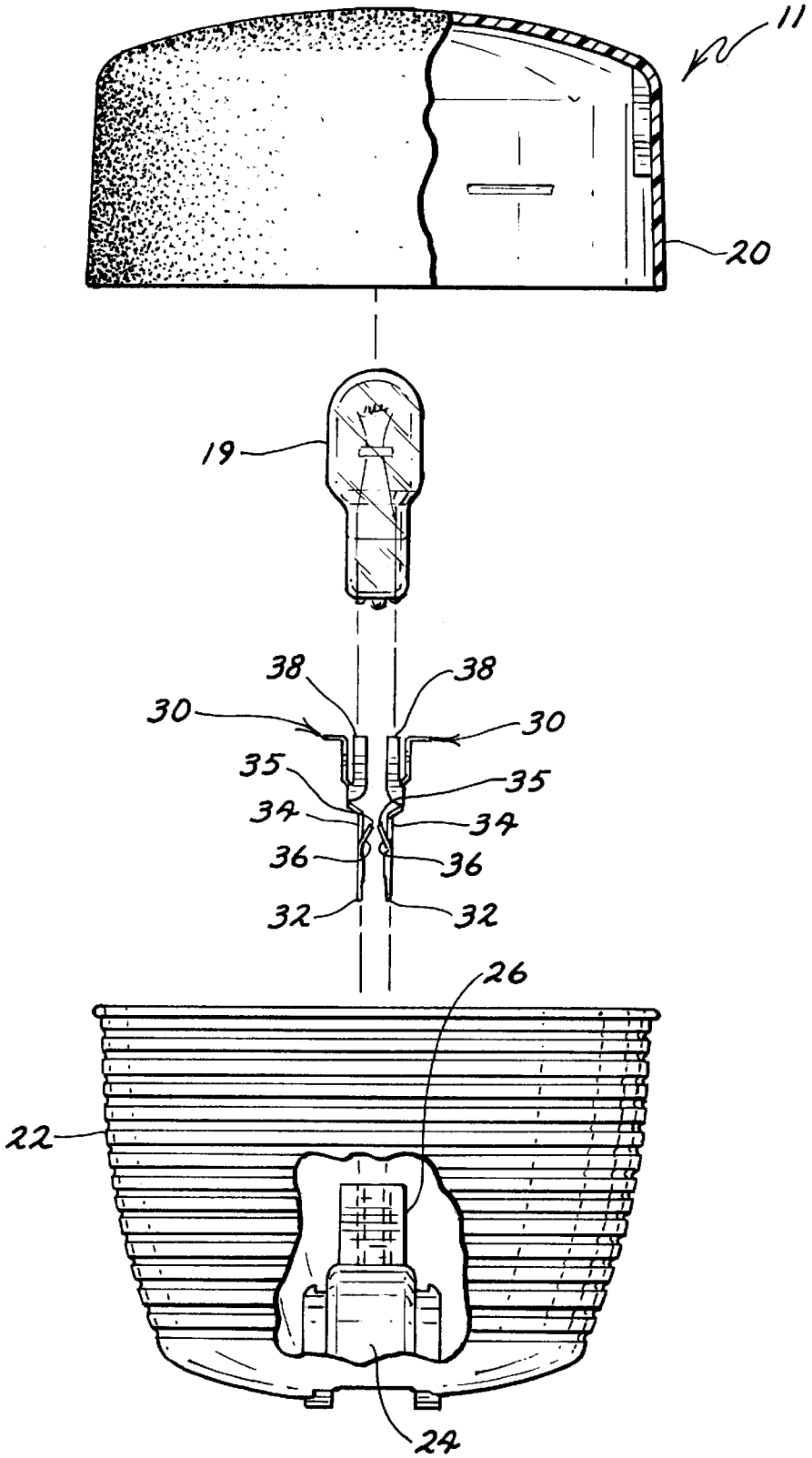
FIG. 2 is an exploded view of the head unit of a low voltage outdoor accent light fixture according to the present invention.

The head unit 11 of the low voltage outdoor accent light fixture 12 is depicted in an exploded view in FIG. 2. The head unit 11 includes a cover 20 and base 22 with a wire cavity 24 formed in the bottom of the base 22. The base 22 also includes a portion 26 adapted to receive conductive members 30. The conductive members 30 are adapted to receive and retain a light bulb 19 as well as make electrical connection with the leads (not shown) on the light bulb 19. The construction of the preferred conductive members 30 will be described more completely below.

The top 20 and base 22 of the head unit 11 can be constructed of any material or materials, although for aesthetic reasons the top 20 is typically opaque while the base 22 is typically translucent and/or transparent. It will be understood that the head unit 11 can be constructed of any combination of opaque, transparent or translucent materials (although use as a light requires that at least a portion of the head unit 11 be either translucent or transparent). The top 20 and base 22 are preferably constructed of polymeric materials, although any suitable materials could be substituted. Likewise, the preferred top 20 and base 22 are molded, but any method of forming the parts could be substituted.

Figure 3:
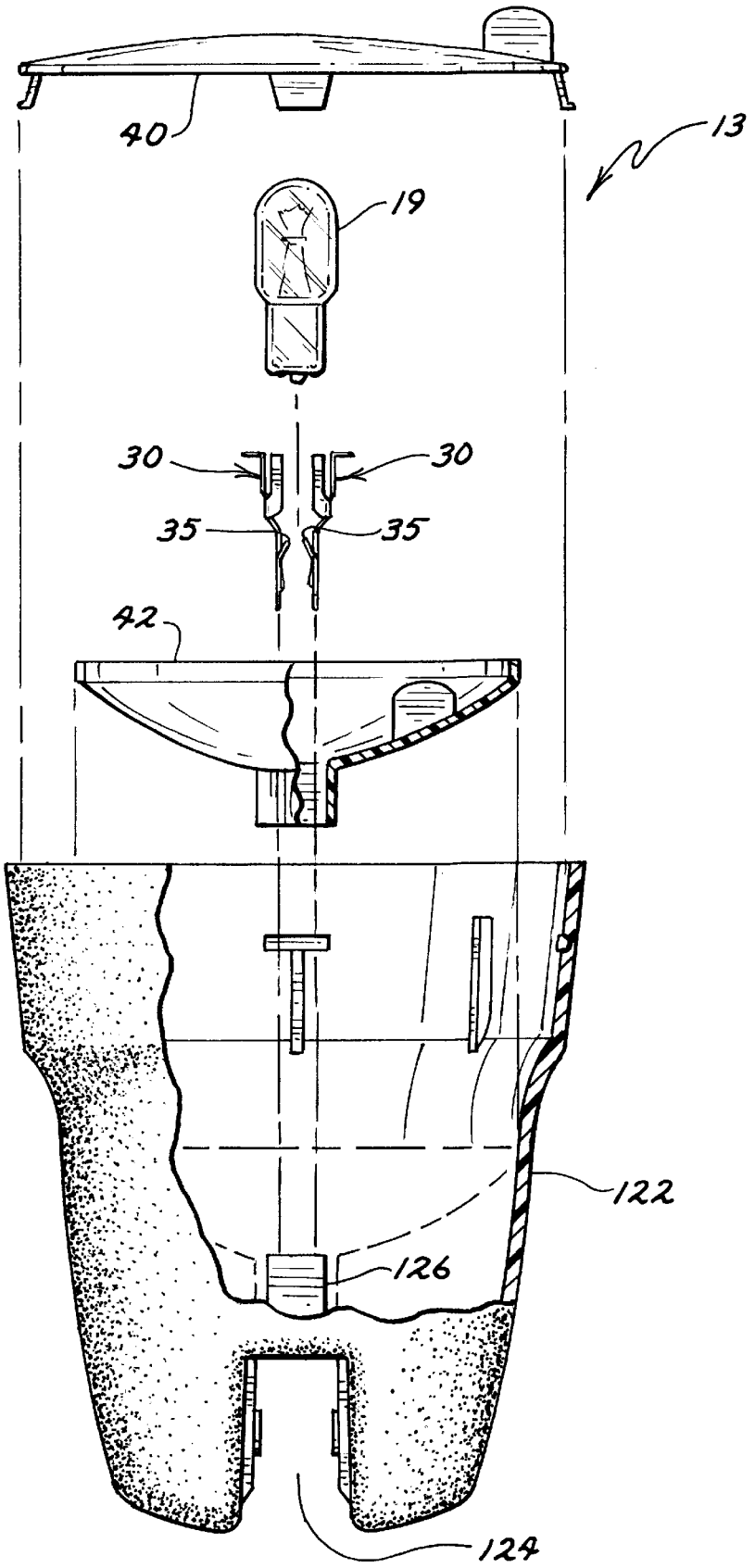
FIG. 3 is an exploded view of a low voltage outdoor floodlight or spotlight according to the present invention.

The head unit 13 of the low voltage outdoor spotlight or flood light fixture 14 is depicted in an exploded view in FIG. 3. The head unit 13 includes a lens 40 and base 122 with a wire cavity 124 formed in the bottom of the base 122. The base 122 also includes a portion 126 adapted to receive conductive members 30. The conductive members 30 are adapted to receive and retain a light bulb 19 as well as make electrical connection with the leads (not shown) on the light bulb 19. The construction of the preferred conductive members 30 will be described more completely below.

The base 122 preferably defines an interior volume in which the bulb 19 is located. A reflector 42 is also preferably located in the interior volume defined by the base 122 to direct light from the bulb 19 in the desired direction. The reflector 42 can be constructed of any suitable material provided that is has the desired reflectivity.

The lens 40 and base 122 of the head unit 13 can be constructed of any material or materials, although for practical use as a floodlight or spotlight, the lens 40 is typically transparent or translucent while the base 122 is typically opaque. It will be understood that the head unit 13 can be constructed of any combination of opaque, transparent or translucent materials. The lens 40 and base 122 are preferably constructed of polymeric materials, although any suitable materials could be substituted. Likewise, the preferred lens 40 and base 122 are molded, but any method of forming the parts could be substituted.

Figure 4:
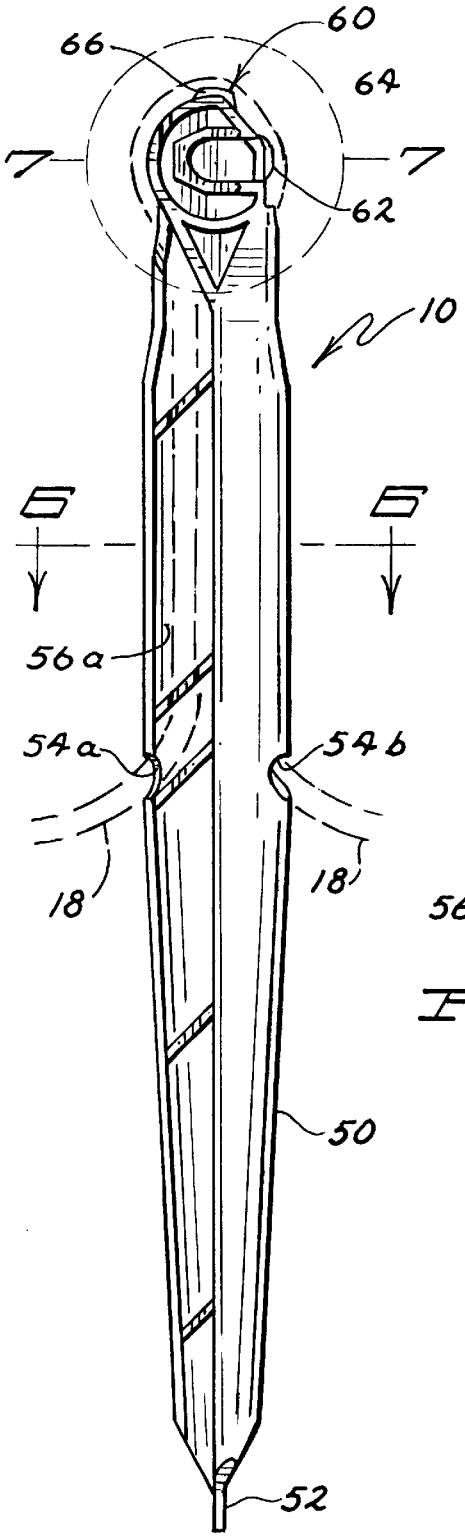
FIG. 4 is a side view of one support member for a low voltage outdoor light fixture according to the present invention.
Figure 6:
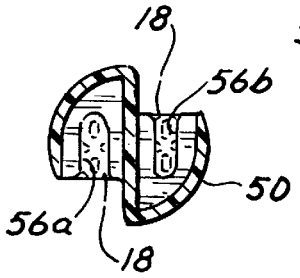
FIG. 6 is a cross-sectional view of the support member of FIG. 4, taken along line 6—6 in FIG. 4.
Figure 5:
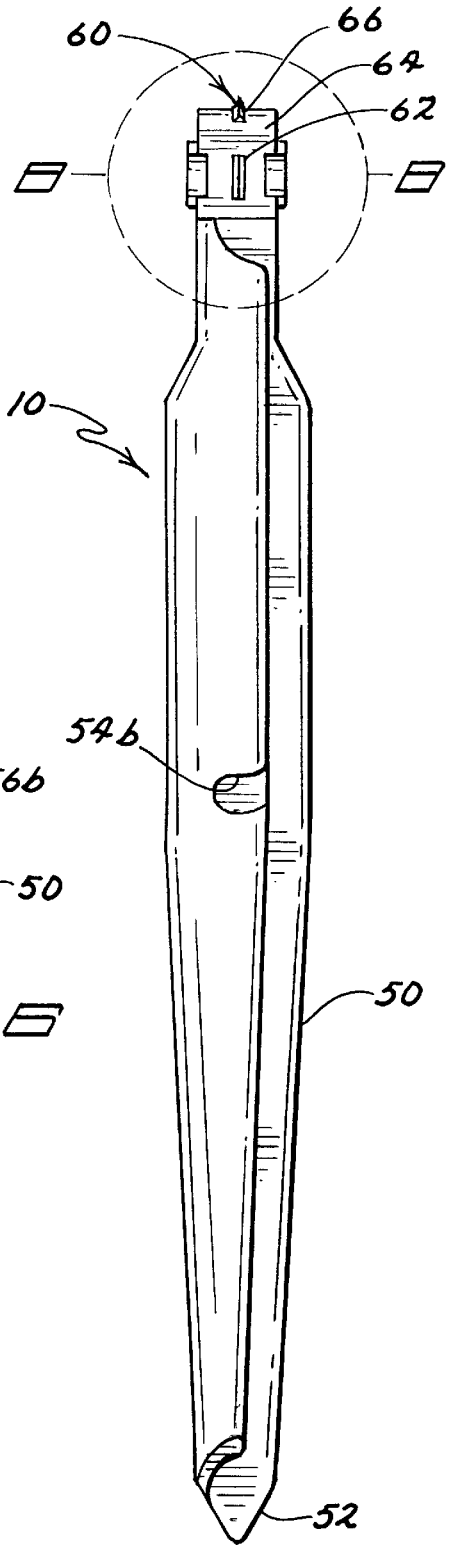
FIG. 5 is a front view of the support member of FIG. 4, i.e., a view from the right of the support member of FIG. 4.
Figure 11:
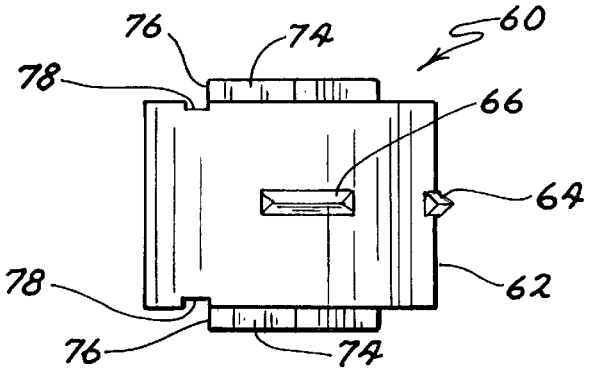
FIG. 11 is an enlarged top view of the support member of FIG. 4.

One embodiment of a support member 10 useful in connection with the present invention is depicted in FIGS. 4–6. The depicted support member 10 functions to support the head units of low voltage outdoor light fixtures according to the present invention as discussed in connection with FIG. 1 above. The preferred support member 10 is a stake having an elongated body 50 with a sharpened or pointed end 52 adapted for insertion into soil, grass, bedding material etc. The support member 10 includes a top end 60 adapted for attachment the head units 11 and 13 to form low voltage outdoor light fixtures 12 and 14 as discussed in more detail below.

The preferred support member 10 includes a pair of openings 54*a* and 54*b* which, respectively, open into channels 56*a* and 56*b* formed in the elongated body 50. The channels 56*a* and 56*b* are adapted to receive and retain a wire 18 such that the wire 18 can be routed over the top 60 of the support member as best seen in FIG. 4.

The construction of the top 60 of the support member 10 is depicted in more detail in FIGS. 7–11. The top 60 includes a wire support surface 62 over which a wire is preferably routed (see, e.g., FIG. 4). Optional alignment ribs 64 and 66 protruding from the wire support surface 62 are provided in the preferred embodiment because the preferred wire includes two conductors aligned in parallel relationship in which the insulation forms a groove into which the alignment ribs extend to assist in aligning the wire on the wire support surface 62.

The preferred means for pivotally mounting the top end 60 of the support member in the wire cavity of a head unit is depicted in FIGS. 7–11. The support member is designed to rotate about an axis 70 running through top 60 as shown. An aperture 72 is provided in which the axis of rotation 70 is located. The aperture 72 is formed with outer surfaces 74 and 76 which cooperate with guides 82 (see, e.g., FIGS. 12, 14 and 15 below) in the wire cavities of the head units as will be more fully described below. The aperture 72 is preferably rounded to facilitate rotation of the support member about axis 70.

The preferred means for pivotally mounting the support member in the wire cavity of the head units provides for a decrease in distance between the wire surface 62 and a piercing element. In the preferred embodiment that movement is provided by a cam formed by the wire support surface 62. The cam action is provided by a change in the distance between the axis 70 and the wire support surface 62. That distance is preferably at a minimum near alignment rib 64 and increases in the direction of the alignment rib 66, where it reaches a maximum. At that point a wire located between the wire support surface 62 and the wire support surfaces in the wires cavities will be forced against wire piercing elements extending out of the wire support surfaces as more fully described below.

The top 60 of the support member 10 also preferably includes guide slots 78 that are used in fixing the rotation of the support member 10 with respect to the base 22 as will be more fully described below.

Figure 12:
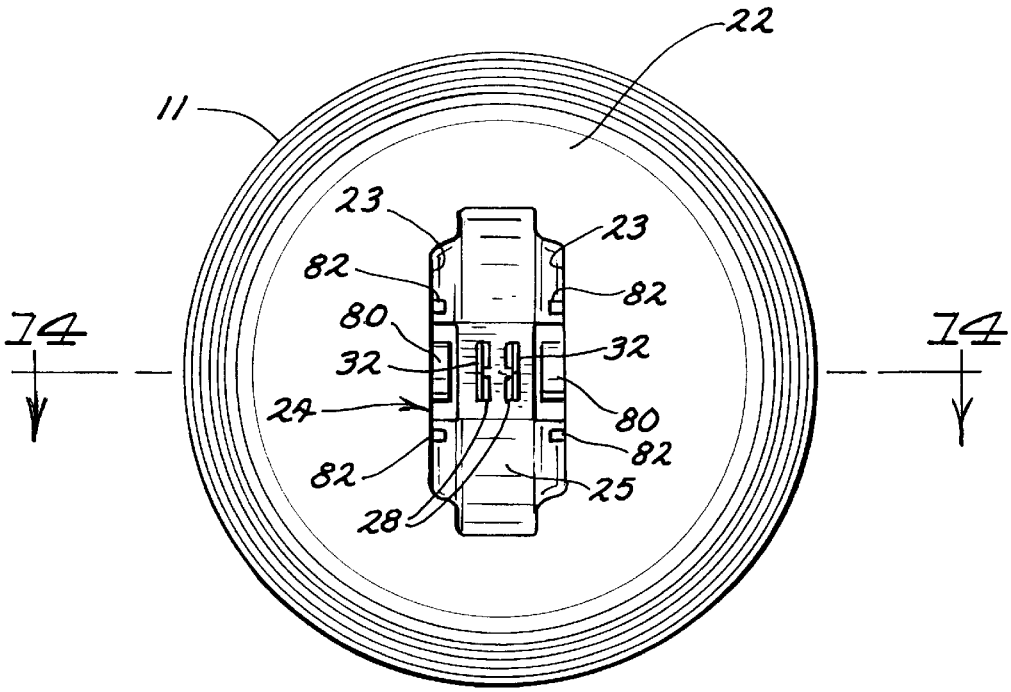
FIG. 12 is a bottom view of the head unit of FIG. 2.
Figure 14:
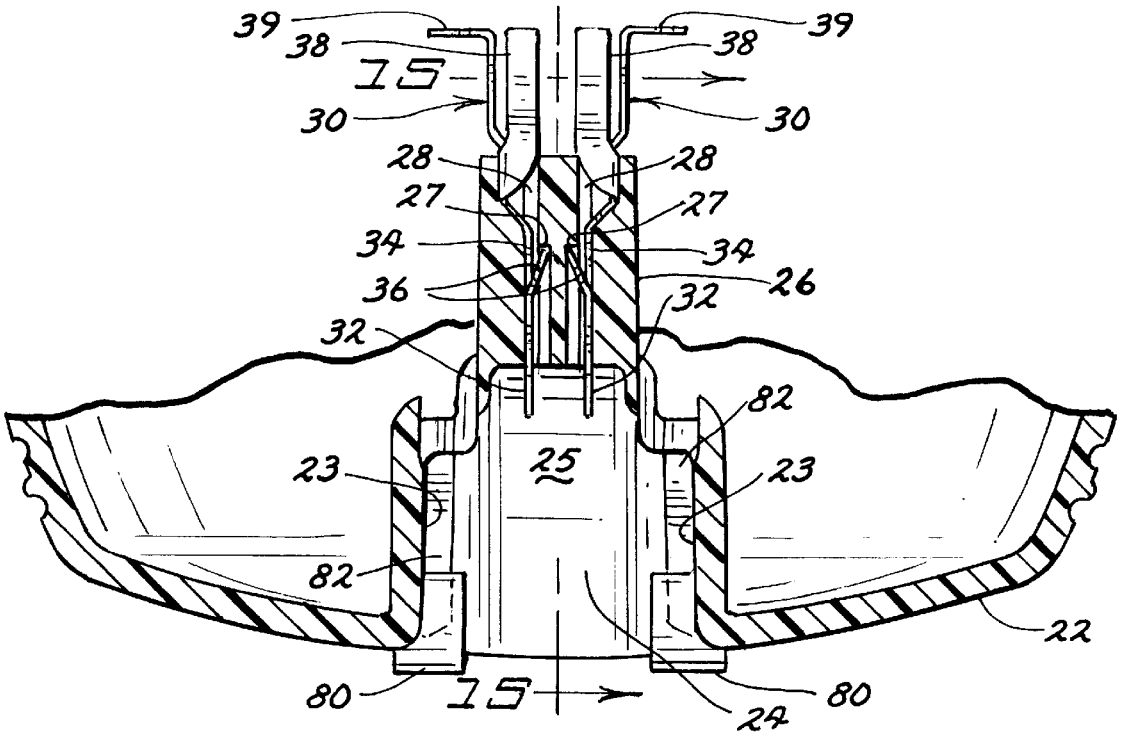
FIG. 14 is an enlarged partial cross-sectional view of the head unit of FIGS. 2 and 12, taken along line 14—14 in FIG. 12.
Figure 15:
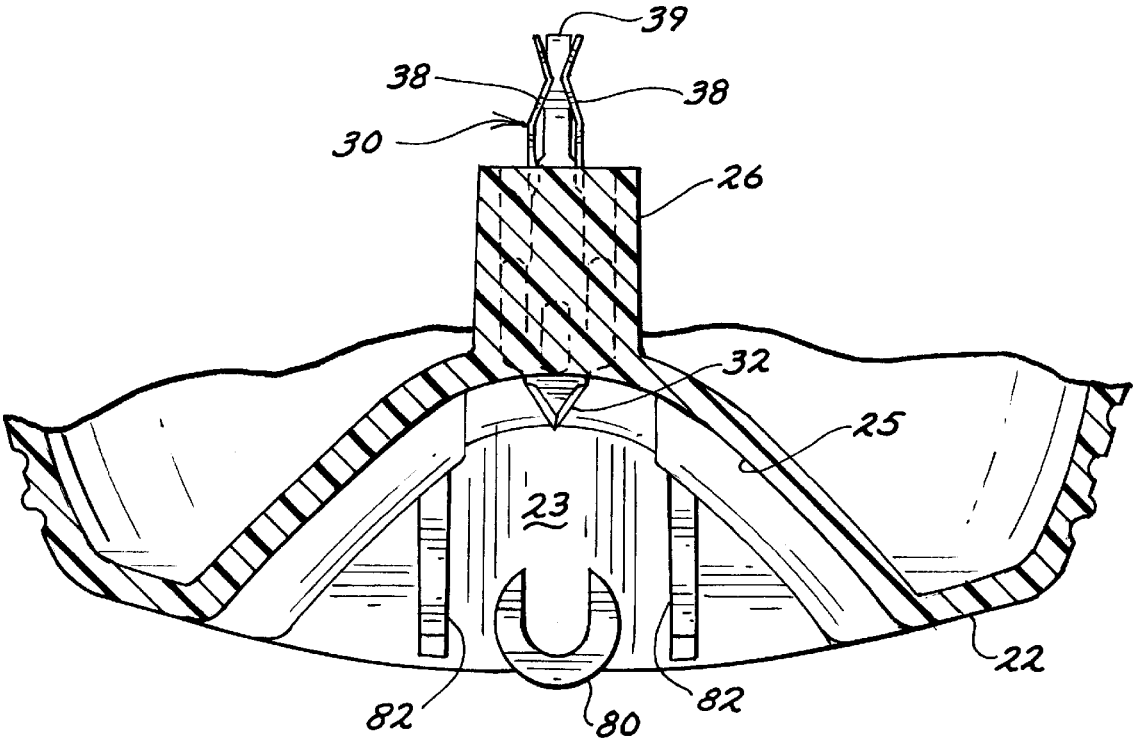
FIG. 15 is a cross-sectional view of the head unit of FIG. 14, taken along line 15—15 in FIG. 14.

The bottom of base 22 of head unit 11 depicted in FIG. 2 is shown in FIGS. 12, 14 and 15. The base 22 preferably includes a wire cavity 24 for receiving a wire and a portion of the support member (see, e.g., FIG. 1). In the preferred embodiment the wire cavity is defined by a generally arcuate wire support surface 25 against which a wire is forced during assembly of the low voltage outdoor light fixture as well as two opposing side surfaces 23.

Figure 7:
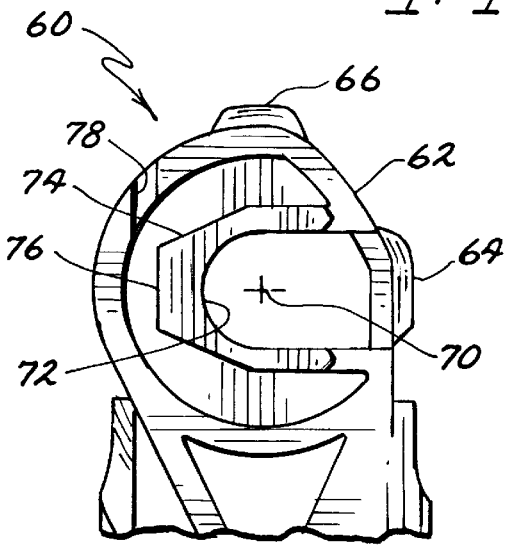
FIG. 7 is an enlarged side view of one end of the support member of FIG. 4 as indicated by line 7—7 in FIG. 4.
Figure 8:
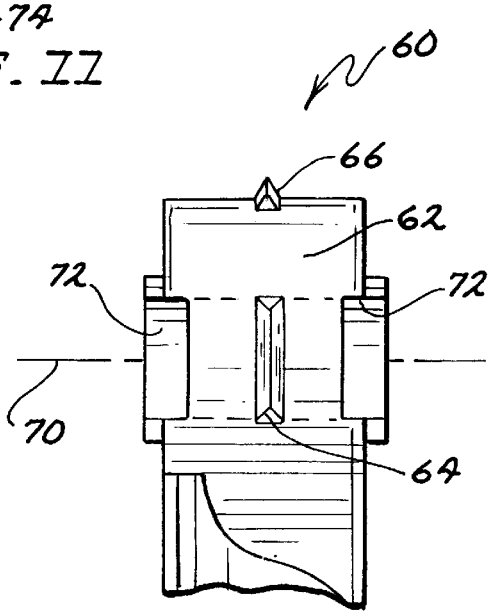
FIG. 8 is an enlarged front view of one end of the support member of FIG. 5 as indicated by line 8—8 in FIG. 5.
Figure 9:
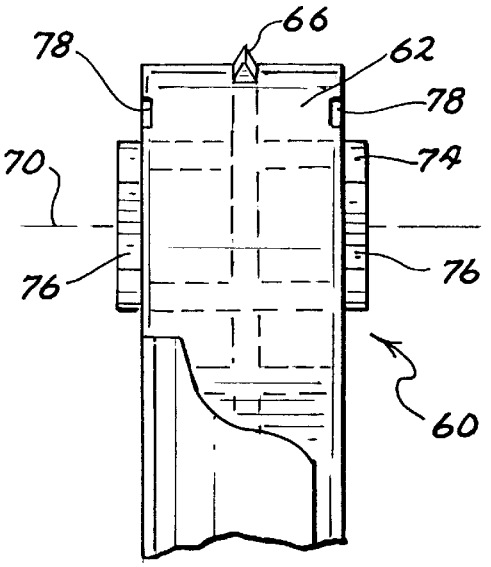
FIG. 9 is an enlarged back view of the end of the support member depicted in FIGS. 4–8.
Figure 10:
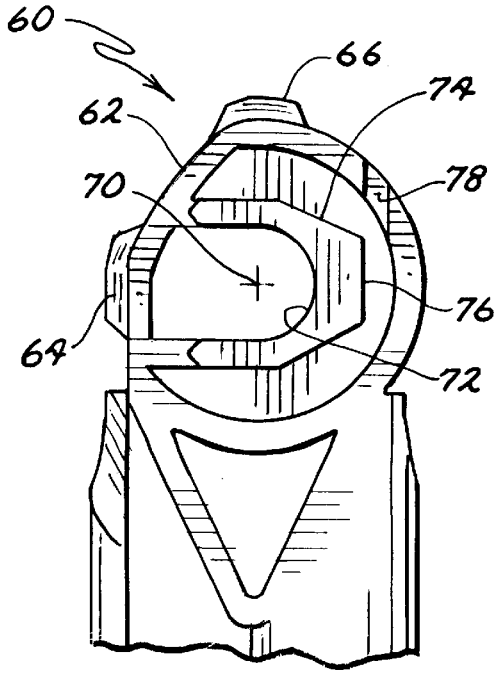
FIG. 10 is an enlarged side view of the opposite side of the end of the support member of FIG. 7.

A pair of opposing studs 80 protrude from the side surfaces 23 as shown and are adapted to fit within the apertures 72 in the support member (see, e.g., FIGS. 7, 8 & 10). The studs 80 are preferably rounded to facilitate rotation of the support member relative to the head unit. The studs 80 also assist in defining the axis of rotation 70 about which the head unit and support member are rotated during assembly of the low voltage outdoor light fixtures.

On each of the studs 80 are a pair of guides 82 that assist in accurate alignment of the aperture 72 in the support member and the studs 80. The guides 82 also preferably function as stops to prevent rotation between the head unit 11 and the support member 10 after assembly as will be more fully described below.

As best seen in FIGS. 14 and 15, the wire piercing elements 32 (two in the preferred embodiment) extend into the wire cavity 24 through the wire support surface 25 in the base 22. The wire piercing elements 32 are located at one end of the conductive members 30 that are located in openings 28 formed in the portion 26 of the base 22.

Each of the conductive members 30 include spring members 38 at the end opposite the piercing element 32. The spring members 38, preferably three, form a light bulb mount on the conductive member 30. The spring members 38 are resiliently biased towards each other such that when light bulb 19 is insert between them, it is both retained therein and electrical contact is made with one of the leads of the bulb 19.

The intermediate spring member 38 preferably includes a flange 39 extending generally transverse to the longitudinal axis of the conductive member 30. One potential function of the flange 39 is to provide a visual reference to ensure proper orientation of the conductive member 30 during manual assembly. If the conductive member 30 is assembled into openings 28 by a machine, the flange 39 is useful for handling the conductive member 30 by a robot manipulator or other device. The flange 39 may also assist in guiding the base of light bulb into proper alignment during insertion in between the spring members 38. In addition, the flange 39 can also provide an additional electrical contact surface for the leads on the bulb 19.

The conductive member 30 also preferably includes an elongated body portion 34 between the spring members 38 forming the light bulb mount and the wire piercing element 32. The body 34 preferably includes one or more, preferably two, ears 36 protruding from the body 34 and forming an aperture 35 that opens towards the light bulb mount. The ears 36 are adapted to cooperate with shoulders 27 formed within openings 28 as best seen in FIG. 14. After insertion of the conductive members 30 into the openings 28, the ears 36 interlock with the shoulders 27 to prevent movement of the conductive member 30 and wire piercing elements towards the interior volume of the base 22. In other words, pressure against the wire piercing elements 32 will not cause them to back out of the wire cavity 24 because the ears 36 will be forced against shoulders 27 with which they are interlocked.

It is preferred that the apertures 35 formed by the ears 36 on the conductive members 30 extend in only one direction from the body 34. As a result, if the conductive member 30 is mistakenly inserted into opening 28 in the wrong orientation, neither of the ears 36 will interlock with the shoulders 27 and the conductive member 30 can be removed and re-inserted into the opening 28 with the proper orientation in which the ears 36 interlock with the shoulders 27.

The preferred conductive members 30 can be manufactured of any suitable material or materials that offer the combination of being electrically conductive and the desired resiliency. Typically, the conductive members 30 will be formed of resilient phosphor bronze, although other materials could be substituted.

Figure 16:
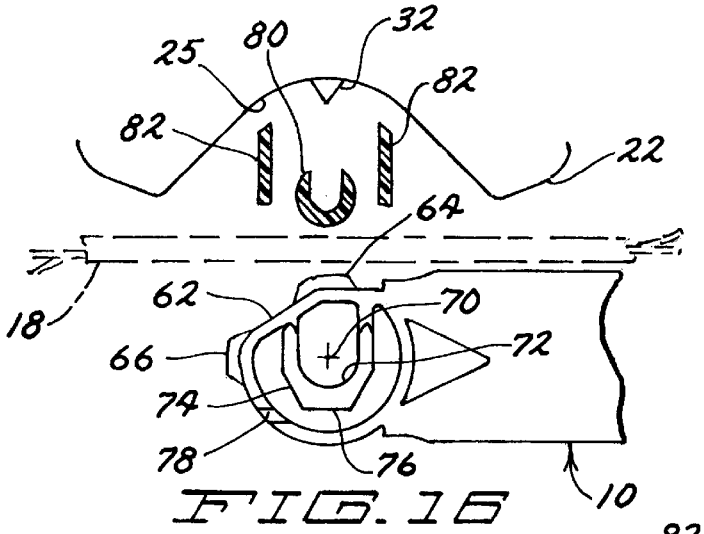
FIGS. 16–18 are schematic diagrams of the initial steps in assembling a head unit and support member in a low voltage outdoor light fixture according one method of the present invention.
Figure 17:
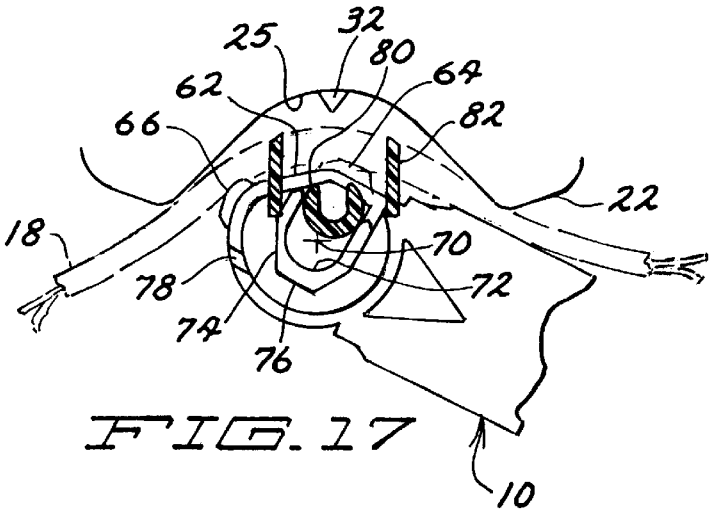
Figure 18:
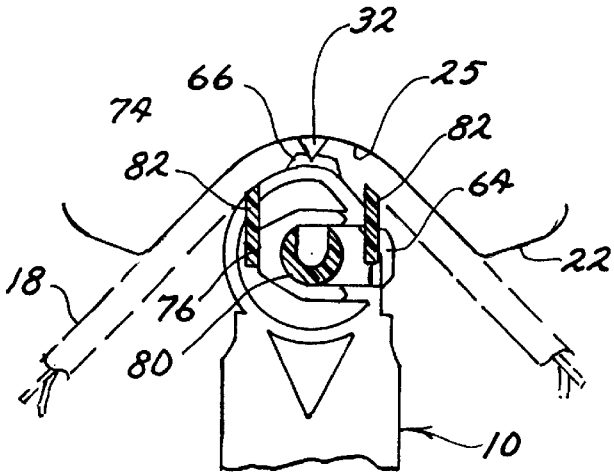

One method of assembling a support member 10 to the base 22 of a head unit 11 is schematically depicted in FIGS. 16–18. A wire 18 is located between the wire support surface 62 of the support member 10 and the wire support surface 25 of the base 22. The apertures 72 on the support member 10 are then aligned with the studs 80 on the base 22 and the support member is moved towards the base 22. The support member 10 in the depicted embodiment is preferably angled slightly as seen in FIG. 17 to align surface 74 on the support member 10 with the guide 82 on the base as shown.

The end of the support member 10 is then moved upwards until the studs 80 are located within apertures 72. After the studs 80 are in position in apertures 72, the support member 10 and base 22 are rotated relative to each other. That rotation moves the wire support surface 62 on the support member 10 closer to the wire support surface 25 and wire piercing elements 32 protruding therefrom.

The movement of the wire support surface 62 is caused, in the preferred embodiment by the cam action provided as an integral part of wire support surface 62 on support member. The movement of the wire support surface 62 towards wire piercing elements 32 causes the elements 32 to pierce the insulation on the wire 18 and make electrical contact with the conductors in the wire. The force required to force the wire piercing elements 32 through the insulation of wire 18 is reduced in the preferred embodiments by the lever arm provided by the support member 10, thereby easing assembly of the low voltage outdoor light fixture.

Figure 19:
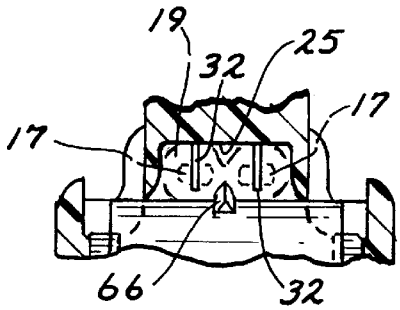
FIG. 19 depicts the relationship between the wire, head unit and support member in FIG. 18.

FIG. 19 is an enlarged view of the relationship between the wire support surface 62 of the support member 10 and the wire support surface 25 of the base 22. The wire 18 is shown as located between the two surfaces 25 and 62 with alignment rib 66 maintaining the proper positioning of the two conductors in the wire 18 by nesting within the channel formed in the insulation of the wire 18.

FIG. 19 also illustrates one preferred embodiment of the wire 18 in which the two conductors 17 are surrounded by insulation 19. The preferred conductors 17 have oval cross-sections (as opposed to the more common circular cross-section). The oval shape of the preferred conductors 17 is oriented such that the major axis is transverse to the movement of the piercing elements 32. As a result, the conductors 17 present a wider target for contact with the piercing elements 32 to reduce the chance of the piercing elements 32 missing one or both of the conductors 17. In one preferred embodiment, the conductors 17 are provided in 18 gauge wire that has been flattened to present a profile to the piercing elements that is substantially equal to the diameter of conventional 16 gauge wire. Wire with ovalized conductors can be obtained from North Wire, Osceola, Wis. It should be understood, however, that the present invention can be used with conventional wire including circular conductors.

Figure 20:
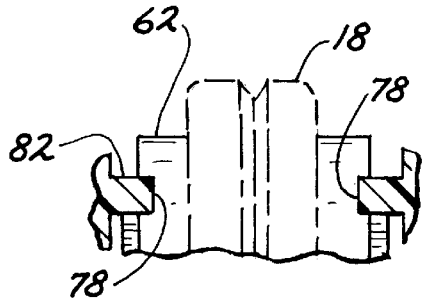
FIG. 20 depicts the relationship between the wire and support member in FIG. 18.

Once the support member 10 is in position with respect to the base 22 as shown in FIG. 18, the guides 82 on one side of the studs 80 preferably lock in place within slots 78 in the support member 10. An enlarged view of the guides 82 seated in the slots 78 is provided in FIG. 20. As a result, further rotation of the support member 10 relative to the base 22 is restricted. In other words, the guides 82 and slots 78 provide a detent mechanism that fixes the orientation of the base 22 with respect to the support member 10. This locking feature is desirable in connection with accent lights. Those of skill in the art will understand that a detent mechanism, provided by the slots 78 and guides 80 in the preferred embodiment, could be produced by many other structures designed to fix the orientation of the base 22 and support member 10 relative to each other. Also, it will be understood that the two pairs of guides 82 on the base 22 are provided to allow assembly of the support member 10 and base 22 in either direction and that only one detent mechanism is required for proper operation of the locking functions.

Figure 13:
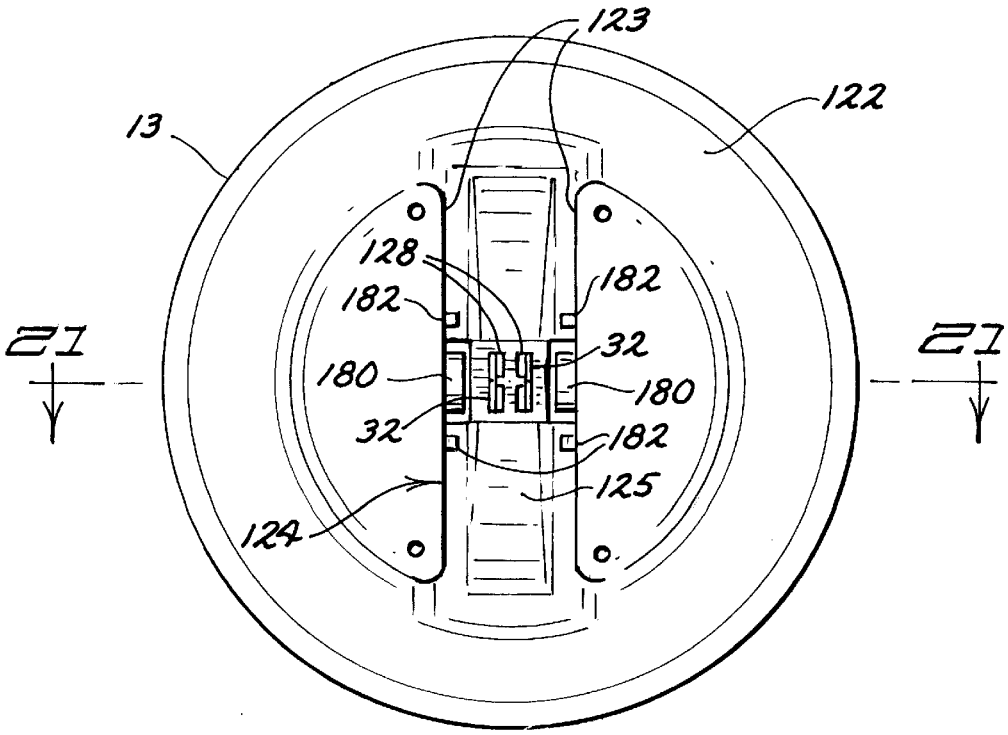
FIG. 13 is a bottom view of the head unit of FIG. 3.
Figure 21:
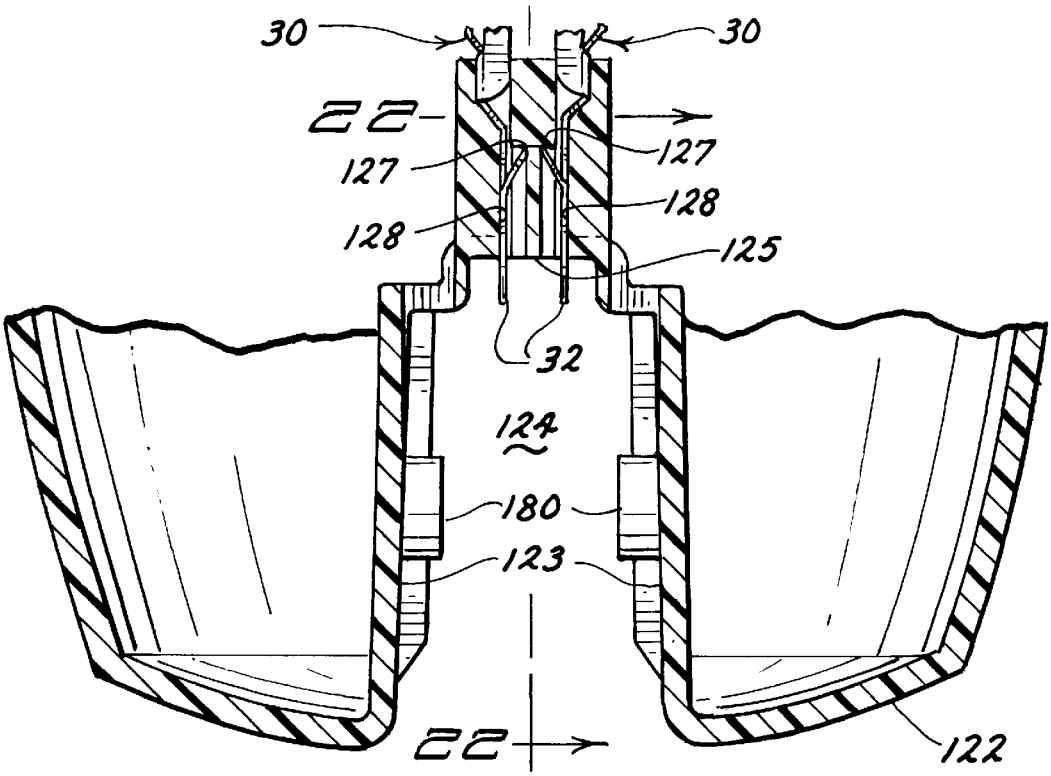
FIG. 21 is an enlarged partial cross-sectional view of the head unit of FIGS. 3 and 13, taken along line 21—21 in FIG. 13.
Figure 22:
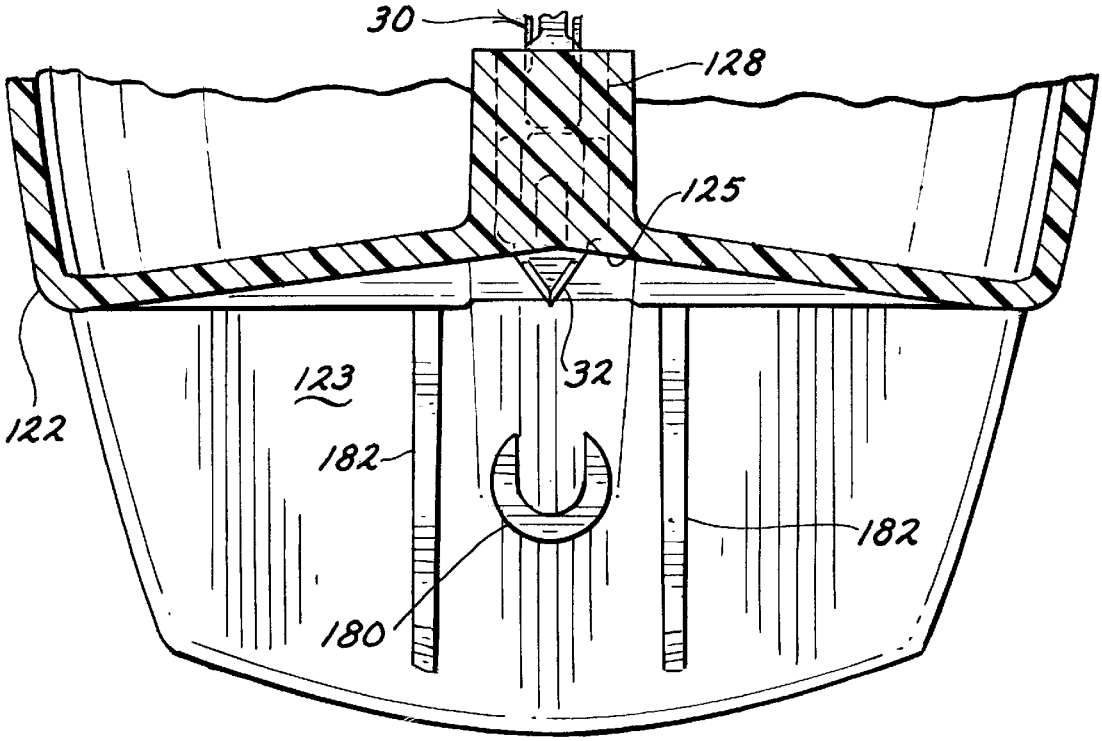
FIG. 22 is a cross-sectional view of the head unit of FIG. 21, taken along line 22—22 in FIG. 21.

The above description has focused on the construction of the base 22 used in accent light fixture 12 according to the present invention. As described above, the support member 10 is preferably fixed relative to the head unit 11 of a low voltage outdoor accent light fixture. The present invention can also be used in connection with a floodlight or spotlight fixture 14. The base 122 of one embodiment of a head unit 13 of such a low voltage outdoor light fixture depicted in FIG. 3 is shown in FIGS. 13, 21 and 22. The base 122 preferably includes a wire cavity 124 for receiving a wire and a portion of the support member (see, e.g., FIG. 1). In the preferred embodiment the wire cavity is defined by a wire support surface 125 against which a wire is forced during assembly of the low voltage outdoor light fixture as well as two opposing side surfaces 123.

A pair of opposing studs 180 protrude from the side surfaces 123 as shown and are adapted to fit within the apertures 72 in the support member (see, e.g., FIGS. 7, 8 & 10). The studs 180 are preferably rounded to facilitate rotation of the support member relative to the head unit. The studs 180 also assist in defining the axis of rotation 70 about which the head unit and support member are rotated during assembly of the low voltage outdoor light fixtures.

On each of the studs 180 arc a pair of guides 182 that assist in accurate alignment of the aperture 72 in the support member and the studs 180. The guides 182 also preferably function as stops to prevent rotation between the head unit 14 and the support member 10 after assembly as will be more fully described below.

As best seen in FIGS. 21 and 22, the wire piercing elements 32 (two in the preferred embodiment) extend into the wire cavity 124 through the wire support surface 125 in the base 122. The wire piercing elements 32 are located at one end of the conductive members 30 that are located in openings 128 formed in the portion 126 of the base 122. The construction of the openings 128 includes shoulders 127 adapted to retain the conductive members 30 in a manner similar to the openings 28 described above with respect to base 22 and will not be further described here.

Figure 23:
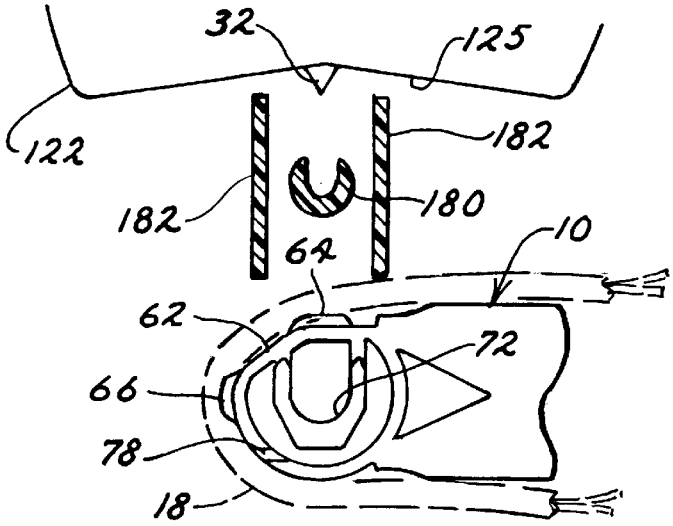
FIGS. 23–25 are schematic diagrams of the initial steps in assembling a head unit of FIGS. 3 and 13 and a support member in a low voltage outdoor light fixture according one method of the present invention.
Figure 24:
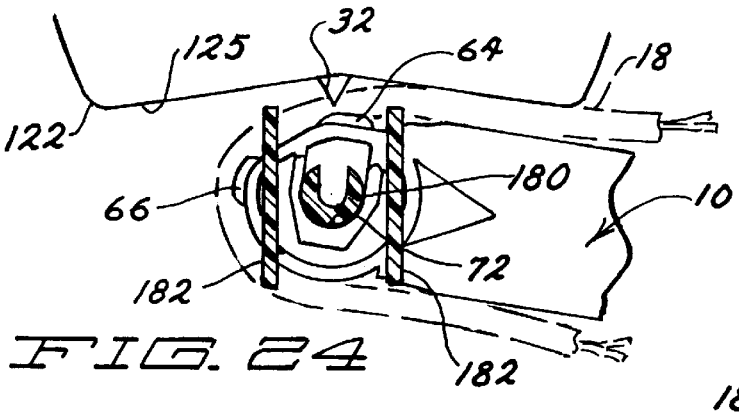
Figure 25:
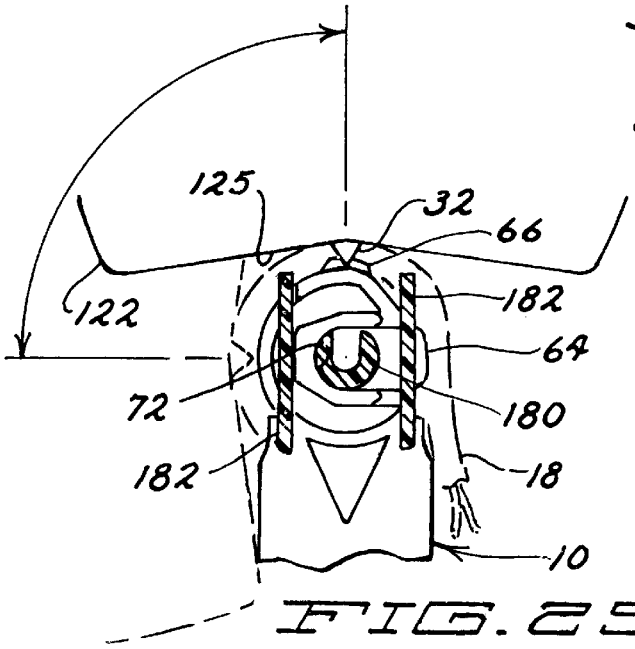

One method of assembling a support member 10 to the base 122 of a head unit 13 is schematically depicted in FIGS. 23–25. A wire 18 is located between the wire support surface 62 of the support member 10 and the wire support surface 125 of the base 122. The apertures 72 on the support member 10 are then aligned with the studs 180 on the base 122 and the support member 10 is moved towards the base 122 until the studs 110 are located within apertures 72. After the studs 180 are in position in apertures 72, the support member 10 and base 122 are rotated relative to each other. That rotation moves the wire support surface 62 on the support member 10 closer to the wire support surface 125 and wire piercing elements 32 protruding therefrom.

The movement of the wire support surface 62 is caused, in the preferred embodiment by the cam action provided as an integral part of wire support surface 62 on support member. The movement of the wire support surface 62 towards wire piercing elements 32 causes the elements 32 to pierce the insulation on the wire 18 and make electrical contact with the conductors in the wire. The force required to force the wire piercing elements 32 through the insulation of wire 18 is reduced in the preferred embodiments by the lever am provided by the support member 10, thereby easing assembly of the low voltage outdoor light fixture.

Figure 26:
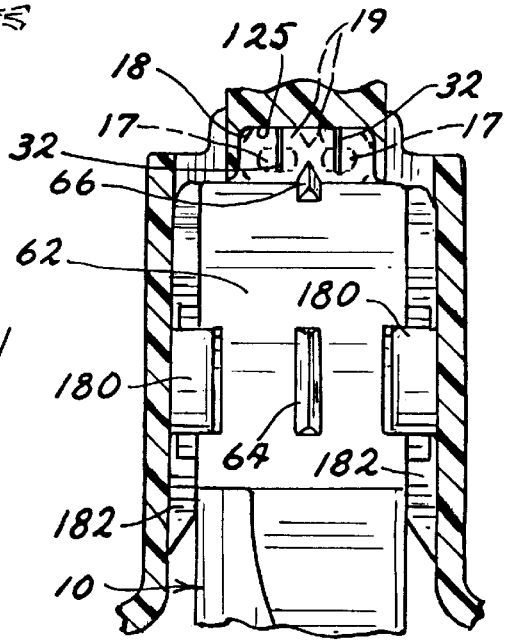
FIG. 26 depicts the relationship between the wire, head unit and support member in FIG. 25.

FIG. 26 is an enlarged view of the relationship between the wire support surface 62 of the support member 10 and the wire support surface 125 of the base 122. The wire 18 is shown as located between the two surfaces 125 and 62 with alignment rib 66 maintaining the proper positioning of the two conductors in the wire 18 by nesting within the channel formed in the insulation of the wire 18. As with the temple light fixture depicted in FIG. 19, the preferred conductors 17 in the wire 18 have an oval cross-section.

The preceding specific embodiments are illustrative of the present invention. It is to be understood, therefore, that variations known to those skilled in the art or disclosed herein may be employed without departing from the invention or the scope of the appended claims. For example, although the support member is recited as including a pair of apertures to receive the studs formed in the bases of the head units, it will be understood that the opposite arrangement could be provided. In other words, the studs could be provided on the support member and the apertures provided on the bases of the head units.

In another variation, although the preferred embodiment includes two opposing sets of studs and apertures about which the support members and head units are rotated, it should be understood that only one stud and one aperture could be provided to guide rotation of the head units and support members about an axis of rotation extending through the stud and aperture.

In yet another variation, it will be understood that although the preferred conductive members described above include two ears, each of which interlock with the shoulders formed in the openings in the head units, the conductive members could include a single ear to accomplish the desired function of preventing the conductive member from backing out of its opening in the head unit.

In the claims, means-plus-function clauses are intended to include the structures described herein as performing the recited function, structural equivalents thereof, and also equivalent structures. For example, although a nail and a screw may not be structural equivalents in that a nail employs a cylindrical surface to secure wooden parts together, whereas a screw employs helical threads, in the environment of fastening wooden parts a nail and a screw should be considered equivalent structures.

What is claimed is:

1. A conductive element for a low voltage outdoor light fixture comprising:

a body having first and second ends;

a wire piercing element proximate the fist end of the body;

a light bulb mount proximate the second end of the body, the light bulb mount comprising at least two opposing spring members capable of receiving a light bulb;

at least one ear protruding from the body, wherein each of the ears forms an aperture with the body, the aperture opening towards the second end of the body; and an intermediate spring member located between the two opposing spring members, wherein the intermediate spring member further comprises a flange oriented generally transverse to a longitudinal axis extending between the first and second ends of the conductive element.

2. A conductive element according to claim 1, further comprising at least two ears protruding from the body, each of the ears forming an aperture with the body that opens toward the second end of the body, and further wherein each of the apertures is located on a first side of the body.

3. A conductive element according to claim 1, wherein the body, the wire piercing element, the light bulb mount, and the at least one ear are provided in a completely integral, one piece unit.

4. A low voltage outdoor light fixture comprising:

a head unit defining an interior volume and a wire support surface;

two openings extending between the interior volume and the wire support surface, a shoulder being formed within each of the openings;

two conductive members, each of the conductive members comprising:

a body having first and second ends, the body located within one of the openings extending between the interior volume and the wire support surface;

a wire piercing element proximate the first end of the body, the wire piercing element extending out of the wire support surface;

a light bulb mount proximate the second end of the body, the light bulb mount comprising at least two opposing spring members capable of receiving a light bulb;

at least one ear protruding from the body, wherein each of the ears forms an aperture with the body, the aperture opening towards the second end of the body, wherein the ear interlocks with the shoulder in the opening such that movement of the wire piercing element of the conductive member towards the interior volume of the head unit is prevented;

an intermediate spring member located between the two opposing spring members, wherein the intermediate spring member further comprises a flange oriented generally transverse to a longitudinal axis extending between the first and second ends of the conductive element; and a light bulb located within the interior volume of the head unit, the light bulb comprising a base located within the light bulb amount.

5. A light fixture according to claim 4, wherein the conductive member comprises at least two ears protruding from the body, each of the ears forming an aperture with the body that opens toward the second end of the body, and further wherein each of the apertures is located on a first side of the body.

6. A light fixture according to claim 4, wherein the conductive member comprises a completely integral, one piece unit.

7. A light fixture according to claim 4, wherein the light bulb receptacle of each of the conductive elements is larger than the opening in which the conductive element is located.

8. A method of assembling a low voltage outdoor light fixture comprising:

providing a head unit defining an interior volume and a first wire support surface, the head unit including two openings extending between the interior volume of the head unit and the first wire support surface, each of the openings including a shoulder formed within the opening;

providing two conductive members, each of the conductive members comprising a body having first and second ends, a wire piercing element proximate the first end of the body, a light bulb mount proximate the second end of the body, the light bulb mount comprising at least two opposing spring members capable of receiving a light bulb; and at least one ear forming an aperture opening towards the second end of the body, the light bulb mount further comprising an intermediate spring member located between the two opposing spring members, wherein the intermediate spring member further comprises a flange oriented generally transverse to a longitudinal axis extending between the first and second ends of the conductive element; and inserting one of the conductive members into each of the openings in the head unit by moving the wire piercing element through the opening to a position in which the wire piercing element extends out of the first wire support surface, wherein the ear on the body of the conductive member interlocks with the shoulder in the opening, whereby movement of the wire piercing elements of the conductive members towards the interior volume of the head unit is prevented.

9. A method according to claim 8, wherein inserting the conductive members comprises inserting each of the conductive members into one of the openings from the interior volume of the head unit.

10. A method according to claim 8, wherein inserting the conductive members comprises manually inserting each of the conductive members into one of the openings.

11. A method according to claim 8, wherein inserting one of the conductive members into each of the openings in the head unit further comprises manipulating each of the conductive members using the flange on the intermediate spring member.

* * * * *